US005982102A

United States Patent [19]

Andrzej

[11] Patent Number: 5,982,102

[45] Date of Patent: Nov. 9, 1999

[54] DEVICE FOR TRANSPORT OF AIR AND/OR CLEANING OF AIR USING A SO CALLED ION WIND

[75] Inventor: Loreth Andrzej, Åkersberga, Sweden

[73] Assignee: Strainer LPB Aktiebolag, Akersberga, Sweden

[21] Appl. No.: 08/945,789

[22] PCT Filed: Apr. 18, 1996

[86] PCT No.: PCT/SE96/00502

§ 371 Date: Oct. 17, 1997

§ 102(e) Date: Oct. 17, 1997

[87] PCT Pub. No.: WO96/33539

PCT Pub. Date: Oct. 24, 1996

[30] Foreign Application Priority Data

Apr. 18, 1995 [SE] Sweden ..... 9501407

[51] Int. Cl.[6] ..... H01J 7/24

[52] U.S. Cl. ..... 315/111.91; 315/111.81; 315/111.31

[58] Field of Search ..... 315/111.81, 111.91, 315/111.31, 111.21; 361/230, 231, 232

[56] References Cited

U.S. PATENT DOCUMENTS 4,380,720 4/1983 Fleck ..... 315/111.91
5,024,685 6/1991 Torok et al. ..... 55/117
5,053,912 10/1991 Loreth et al. ..... 361/230
5,077,500 12/1991 Torok et al. ..... 315/111.91

FOREIGN PATENT DOCUMENTS

86/07500 12/1986 WIPO .

*Primary Examiner*—Don Wong
*Assistant Examiner*—Wilson Lee
*Attorney, Agent, or Firm*—Pearne, Gordon, McCoy & Granger LLP

[57] ABSTRACT

A device for transporting air with the aid of so-called electrical ion-wind, said device including at least one corona electrode (10), e.g. thread shaped, that extends transverse to the air flow path, and at least one target electrode (16) and one duct electrode (12) provided downstream of the corona electrode, said target electrode (16) and said duct electrode (12) being connected to respective terminals of a d.c. voltage source (11) having such a voltage that a corona discharge generating air ions occurs at the corona electrode. The duct electrode (12) is designed of both a current carrying frame and an electrically insulating casing therearound and hence the around the corona electrode (10) generated ions will not be able to reach the current carrying frame of the duct electrode (12).

10 Claims, 2 Drawing Sheets

DEVICE FOR TRANSPORT OF AIR AND/OR CLEANING OF AIR USING A SO CALLED ION WIND

BACKGROUND OF THE INVENTION

The present invention relates to a device for transporting air with the aid of so-called ion-wind or corona-wind.

Such a device according to previously known technique includes in principle an air flow duct and a corona electrode and a target electrode arranged axially spaced from each other in the air flow duct, said target electrode located downstream of the corona electrode, seen in the desired air flow direction.

The corona electrode and the target electrode are connected to a respective terminal of a direct-current voltage source, the design of the corona electrode and the potential difference and distance between the corona electrode and the target electrode being such that a corona discharge occurs at the corona electrode. This corona discharge results in air ions having the same polarity as the corona electrode and possibly also charged so-called aerosols, i.e. solid particles or liquid drops present in the air, said particles or drops being charged upon collision with the charged air ions. The air ions move rapidly, under influence of the electrical field, from the corona electrode to the target electrode, where they relinquish their electric charge and again become re-charged air molecules. During this movement the air ions permanently collide with the non-charged air molecules and thus the electrostatic forces are transferred to these latter air molecules, which are thus drawn in a direction from the corona electrode towards the target electrode, thereby causing an air transport in the shape of a so-called ion-wind or corona-wind through the air flow duct.

Preferred designs of air transporting devices of the type mentioned above are described e.g. in the international patent application PCT/SE85/00236. In air transporting devices of this type the corona electrode can be designed e.g. as a wire-shaped electrode element, said wire-shaped electrode element extending across the air flow duct that has a rectangular or square cross-section, the wire-shaped corona electrode elements being provided transverse to the longitudinal axis of the duct.

Problems related to other types of corona electrode elements and the adherent design of the air flow duct, are of the same character as the problems that are solved by the present invention. Thus the below description of these problems are focused to embodiments having an elongated corona electrode as ion source, said design being the most frequent in practical tests.

As can be learnt from the international patent application mentioned above the efficiency of the air transport is directly dependant on the product of the ion current, i.e. the strength of the corona current and the distance between the corona electrode and the target electrode. Further the ion current should be as evenly distributed as possible across the whole cross-sectional area of the air flow duct. However, it has turned out that the walls of the air flow duct, said walls normally having an insulated inner side and a conducting earthed outer side, exert a disturbing action upon the corona discharge, and thus upon the corona current and the so-called ion-wind.

This screening and disturbing influence causes in practice that ion-wind devices are designed having relatively wide air flow ducts. The consequence of this is that the air flow velocity through the duct is very uneven and unfavourable in that the velocity is high in the center plane of the duct downstream of the corona electrode and a dramatically decreased air flow velocity as the distance to the centre plane increases.

As regards air cleaners designed according to the ion-wind technique this means that inter alia the separating part, i.e. the so-called precipitator, must be given dimensions based on very unfavorable air flow conditions. To use some kind of mechanical restriction of the air flow to achieve an even air flow through the precipitator of previously known devices is out of question from a practical point of view, since there is not sufficient generation of pressure in the device to compensate the drop in pressure that such a mechanical restriction would initiate.

Certain attempts have been made to reduce or eliminate the screening effect of the air flow duct, said attempts being described in the international patent application mentioned above. According to this application so-called exitation electrodes are provided on the inner side of the current carrying surfaces of the air flow duct, the purpose of said exitation electrodes is to improve the conditions for generating the so-called ion-wind in the air flow duct by connecting the exitation electrodes to a suitable voltage.

This method has a limited effect and rather than solving the problems described above said method creates electrically defined conditions in the duct including well defined electrode elements that in their turn have a screening effect in a more defined way than the dielectric surfaces of the duct. Especially in narrow flow ducts this method of solving the problems is not suitable.

The aim of the present invention is among other things to provide an air transporting device using so-called ion-wind or corona-wind, said device being free from the problem discussed above, the aim also being to essentially improve the efficiency of the ion-wind device both as regards the air transport and air cleaning as well as regards the simplicity and safety of operation compared to prior art. There are further aims of the present invention that will be described below.

SUMMARY OF THE INVENTION

In accordance with the present invention, a device is provided for transporting air with the aid of electrical ion-wind. The device includes at least one corona electrode. A duct electrode is located at a distance from the corona electrode. A d.c. source is provided having a first terminal connected to the corona electrode and a second terminal connected to the duct electrode. The design of the corona electrode and the voltage between said terminals of the d.c. voltage source are such that a corona discharge generating air ions occurs at the corona electrode. The duct electrode includes a material having a certain conductivity. The duct electrode is connected to the second terminal of the d.c. voltage source. The insulating material has electrically insulating properties and is disposed between the corona electrode and the duct electrode such that essentially no current reaches the duct electrode.

BRIEF DESCRIPTION OF THE DRAWINGS

Below the invention will be described more in detail with reference to Whe accompanying drawings that by way of example illustrates sore embodiments of the invention, FIG. 1 schematically showing by way of example a first embodiment of an air transporting device according to the invention.

DETAILED DESCRIPTION OF THE PREFERRED EMBODIMENTS

Figure 1:
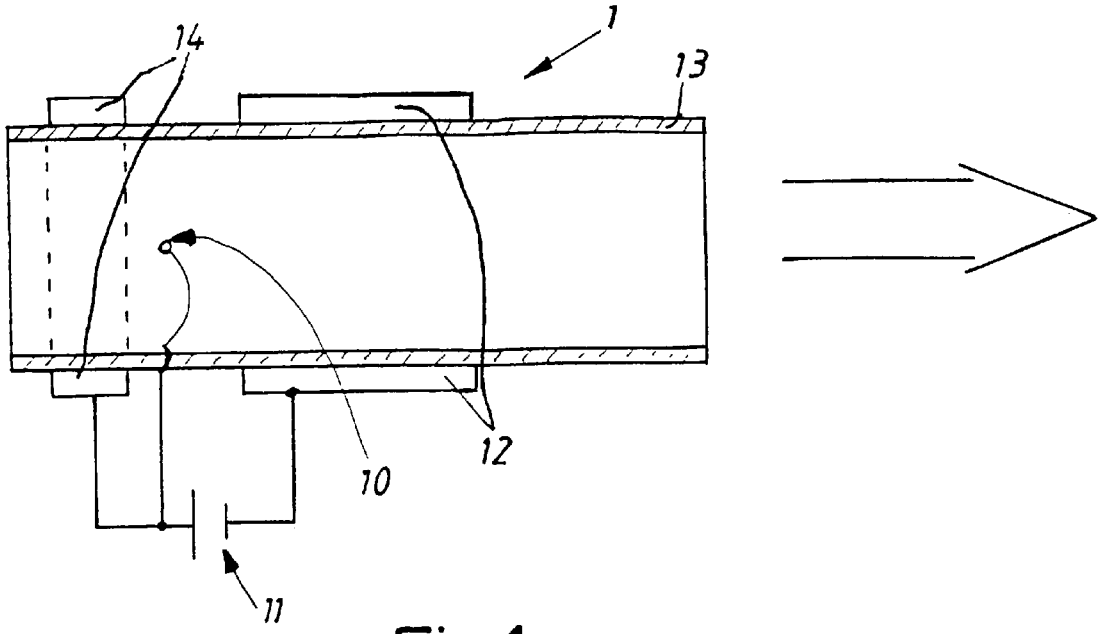

The device includes an air flow duct 1 having rectangular cross-section, a corona electrode 10 being so arranged that the air flow duct extends both upstream of and downstream of the corona electrode 10. In this example the corona electrode 10 constitutes of a single, straight wire that extends across the air flow duct along the rectangular cross-section of the duct, the side walls of the air flow duct being made out of insulating material. In the disclosed example the corona electrode 10 is connected to a terminal of a high voltage source that is positive relative to earth potential.

Both downstream of and upstream of the corona electrode 10 the side walls of the duct 1 are coated with current carrying coatings, hereinafter named the duct electrode 12 and the duct electrode 14. Said electrodes 12 and 14 respectively are electrically insulated from each other and connected to the respective terminal of the high voltage source in such a way that the duct electrode 12, provided downstream of the corona electrode 10, is connected to the opposite terminal of the high voltage source compared to the corona electrode. The duct electrode 14 provided upstream of the corona electrode 10 is connected to voltage of the same polarity relative to earth as the voltage of the corona electrode.

From the patent application PCT/SE85/00236 mentioned above it can be learnt that for an ion-wind device having the corona electrode and the target electrode arranged in an air flow duct the product of the corona current and the distance between the corona electrode and the target electrode, i.e. the migration path of the ion current, is proportional to the efficiency of the air transport.

The present invention differs from previously known ion-wind technique e.g. in the way the ion current is produced and the way said current is forced to migrate in the desired air flow direction, i.e. the way to achieve the ion migration distance.

In the device according to FIG. 1 the ions are generated around or in the vicinity of the corona electrode 10 due to the electronic field that is created between the duct electrode 12 and the corona electrode 10. At a suitable voltage between said electrodes the field concentration around the corona electrode 10 is sufficient to give rise to generation of air ions. A d.c. voltage source 11 creates the potential between the corona electrode 10 and the duct electrode 12.

The ions do not reach the duct electrode 12 due to the insulated interior surface 13 of the duct.

Instead the ions are forced to spread in the desired air flow direction on one hand due to the repelling forces between the ions and on the other hand due to the field from the corona electrode 10 and the field from the duct electrode 12. However, to achieve the best efficiency the migration of the ions in the opposite direction must be prevented.

In the disclosed embodiment this is carried out by the duct electrode 14 with the aid of the electrostatic field that the duct electrode 14 creates upstream of the corona electrode 10, said field effectively repelling the ion clouds and prevents the migration of the ion clouds in the undesired direction, i.e. against the air flow direction through the device.

In the disclosed example of the simpliest embodiment of the device according to the present invention, the ions terminate their migration through the air duct channel by spreading in the space where the device is located.

The ion balance in the air flow duct is maintained due to the generation of new air ions around the corona electrode 10 at the same pace as others leave the duct. During this motion of the ions in the air flow duct they permanently collide with the non-charged air molecules, the electrostatic forces being transferred also to said air molecules that are carried in the desired direction in the shape of a so called ion-wind or corona-wind.

It should be noticed that as regards the expression conductive layer in the present description the expression "conductive" is to be interpreted in view of the circumstance that the layer or the material not is intended to conduct hardly any current and thus its conductivity can be very low and even highly resistive or antistatic.

Figure 2:
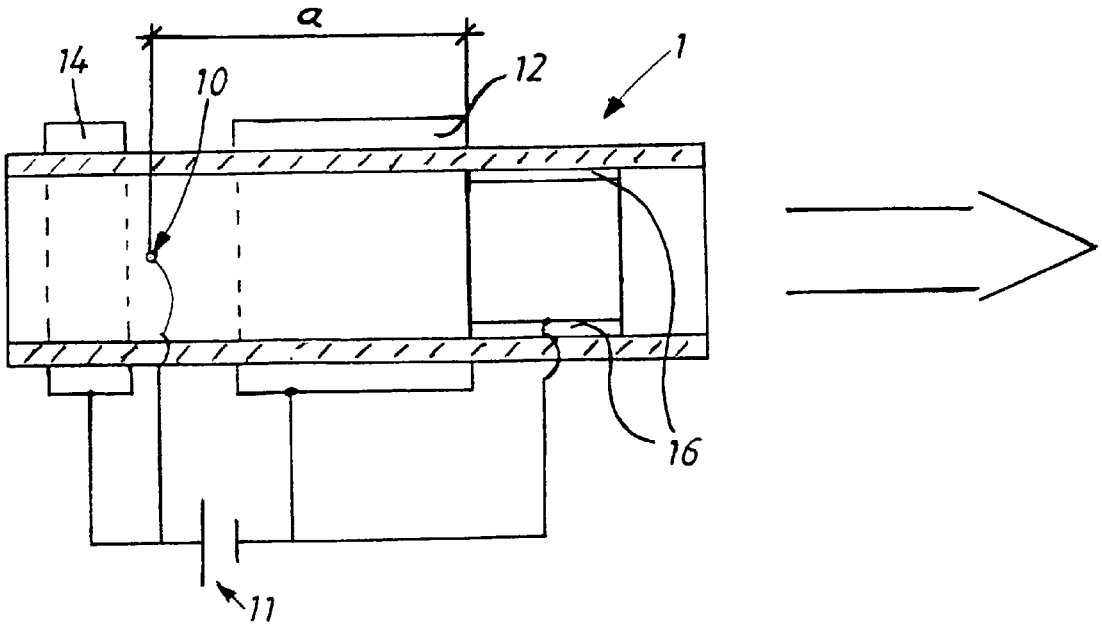
FIG. 2 shows an alternative embodiment of the device according to the invention.

FIG. 2 shows schematically a further development of the invention according to FIG. 1. As is shown in FIG. 2 a current carrying element is arranged on the inner side of the the air flow duct, said element below being called a target electrode 16 and is in accordance with the disclosed embodiment located downstream of the corona electrode 10 at a distance "a" measured in axial direction of the duct. In the disclosed embodiment the target electrode 16 extends around the walls of the air flow duct along the entire periphery. Preferably the target electrode 16 is connected to the negative terminal of a d.c. source 11 and is at essentially the same potential as the duct electrode 12.

The target electrode 16 can be designed in several different ways, e.g. in the shape of lamellas that are essentially parallel to the air flow direction through the device, said lamellas being provided on or adjacent to the inner walls 13 of the air flow duct in the shape of a net or a perforated surface, a mesh or the like. It is also possible that the target electrode 16 constitutes a part of the so called precipitator, i.e. a part of the air flow duct of the ion-wind device where the separation of charged aerosol particles take place. However, it is essential that the target electrode 16 allows the air flow to pass through the target electrode 16, said target electrode being made out of or coated with material having a certain conductivity. It is also of a certain practical preference to electrically connect the target electrode 16 to the duct electrode 12.

Between primarily the ion clouds that in the disclosed embodiment are positively charged and the target electrode 16 a powerful electrostatic field is created, said field puts the ion clouds in motion towards the target electrode 16.

The efficiency of the device, i.e. the air flow velocity, increases significantly in the duct compared to the example according to FIG. 1. The ions terminate their migration on the target electrode 16 where they give off their charge and become neutral air molecules in the same pace as new ions are generated around and in the vicinity of the corona electrode 10.

According to a practical design of the device of the present invention the axial distance "a" from the corona electrode 10 to the target electrode 16 is 10 cm and preferably from 13 to 15 cm, also when the air flow duct has a width, measured perpendicular to both the extension of the corona electrode and the desired air flow direction through the duct, of about 3 to 10 cm.

At a voltage of about 17 kV for the corona electrode 10 and −17 kV for both the duct electrode 12 and the target electrode 16, the air flow duct having a width of 5 cm and the axial distance "a" from the corona electrode 10 to the target electrode 16 being 15 cm, the electrostatic field from the corona electrode hardly or to a very little extent reaches the target electrode 16.

This is important in practice since a powerful electrostatic field between the corona electrode and the target electrode in previously known ion-wind devices often imposes an undesired discharge from the target electrode to the corona electrode, the so called back corona discharge. This discharge is audible and imposes a high degree of ozone generation, this being an extremely undesired phenomenon that to an essential degree has restrained the use of ion-wind technique in practical applications. The grounds of this phenomen lie in the powerful electrostatic field that exists between the corona electrode and the target electrode, especially when the disturbing and screening effect from the walls of the air flow duct are compensated through increase of the voltage between the electrodes, this being the case for previously known ion-wind technique. The present invention solves also this problem.

In the disclosed example according to FIG. 2, by means of the duct electrode 14 the screening of the ion clouds is provided in a direction opposed to the desired air flow through the device. The duct electrode 14 can be designed in different ways, e.g. in the shape of lammellas allowing the air to pass through and arranged in parallel to each other, as well as a grid or a net being so designed that a current carrying frame is surrounded by an electrically insulating casing.

This device is not necessarily 100% effective. The benefit of this solution for the screen electrode, compared to the one previously known from e.g. PCT/SE85/00236, is that in practical design of the device the duct electrode constitutes also inlet grid of the device without causing discomfort upon touch.

The device according to the invention is so far described in connection with an elongated corona electrode arranged transverse to the longitudinal axis of the duct. According to this invention the corona electrode can be designed in accordance with previously known technique or preferably in accordance with both the description below and the characterizing features of the invention. In laboratory tests it has shown that use of a pointed corona is not suitable in connection with so called corona discharge. The reason for this is that positive corona discharge from a pointed electrode after a certain, time of use becomes unstable in such a way that the discharge develops into a so called streamer discharge, a phenomenon that is similar to a slightly audible luminous arc generating high quantities of ozone.

It has been shown experimentally that the risk of unstableness for corona discharge decreases essentially if the corona electrode is designed by very thin, short threads that prefereably are grouped in a common holder or distributed across the cross-section of the air flow duct at essentially the same axial distance from the target electrode 16, said threads extending with their free ends essentially in the desired air flow direction or, if the corona electrode is designed as a point, said point constitutes of or is coated with platina.

It has been shown experimentally that the unstableness depends upon deposits of probably highly resistive materials close to the free end of the point. Due to this knowledge further practical improvement of the functional operation of the device according to the invention is effected by providing a suitable cleaning device, preferably upstream of the corona electrode 10, seen in the air flow direction. Said cleaning device 18 and/or the corona electrode 10 are designed in such a way that through mutual movement, e.g. around the longitudinal axis of the corona electrode 10, the pointed elements of the corona electrode 10 may have their free ends cleaned by scraping. It has turned out experimentally that this higly resistive coating has a very low adherence capacity and therefore a very low degree of friction recreates the original properties of the thread or point.

Figure 3:
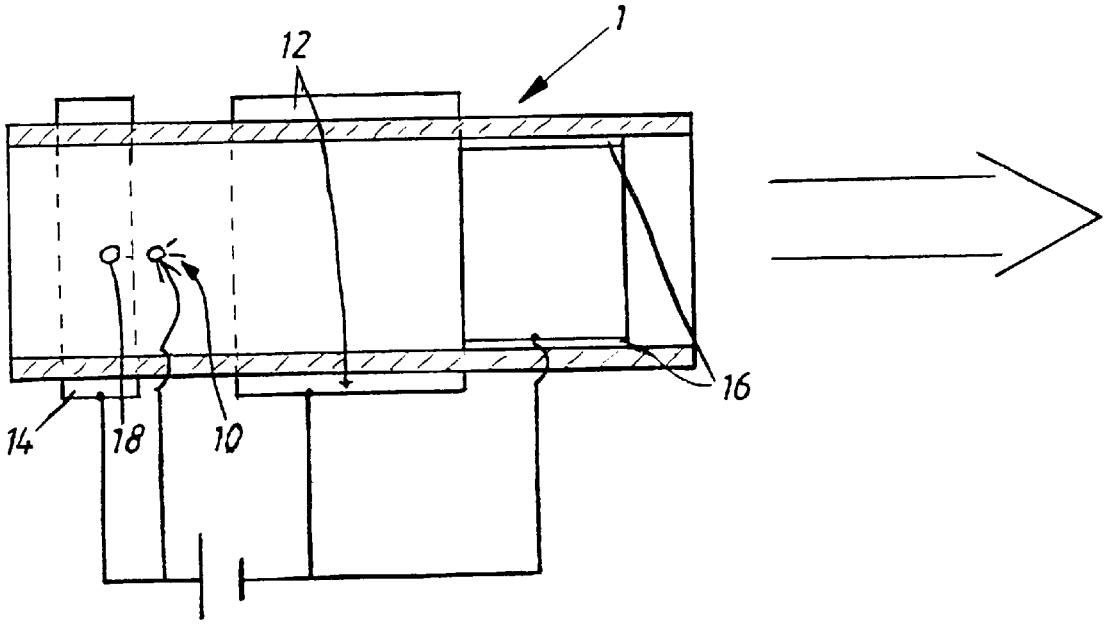
FIG. 3 shows still a further alternative embodiment of the device according to the invention.

Such an embodiment is shown in FIG. 3. The corona electrode 10 constitutes of a holder and very thin, short thread-shaped elements extend from said holder, said elements preferably being made out of resilient material and having an extension essentially in the air flow direction. The elements are electrically connected to the positive terminal of the high voltage source, either by groups or separately.

As shown, the corona electrode 10 is designed in such a way that it can perform a turning movement around its axis in a way that is not disclosed in detail. By this movement friction is created between the resilient corona elements and a device 18 arranged upstream of the corona electrode, seen in the air flow direction. The surface of said device 18 is preferably uneven or bumpy in order to achieve effective scraping of the free ends of the electrode element. The device 18 preferably constitutes of a screen/scrape. It is not necessary that the device where the corona electrode constitutes of one or more thread-shaped corona elements or one or more points is designed in accordance with FIG. 3. It is however essential that the diameter of the thread is smaller than 0.2 mm, and preferably 0.1 mm, if short, resilient elements are used for said purpose. In case of a point it should constitute of platina or being coated with platina. Also it should be guaranteed that the corona element will establish a frictional contact with suitable elements to remove possible depositions on the free ends of the corona element.

In the patent application PCT/SE85/00236 there is a detailed description of the ion-wind principle, said description giving the knowledge of the parameters defining the efficiency of the ion-wind, i.e. the ion stream and its migration distance, i.e. the distance from the corona electrode to the target electrode.

However, it turned out that this presented mathematical model was not sufficient to calculate in absolute terms the volume of the transported air through an air flow duct for given parameters, like the measures of the duct and the distance between the electrodes and the magnitude of the corona current. The reason therefore is that the disturbing and screening effect from the walls of the air flow duct, as described above, affects the density of the ion flow measured in the cross-section of the air flow duct, said density being high in the centre plane of the duct and decreases dramatically further away from said centre plane.

By means of the duct electrode 12, the present invention increases the efficiency of the ion-wind device by equalizing the ion density measured in the cross-section of the air flow duct.

Said duct electrode 12 is to be designed as shown in the example of FIG. 1 and 2 or in several different ways like a fully covering surface or coating or a not fully covering surface, i.e. in the shape of a pattern, e.g. net-like. Said duct electrode 12 may be mounted on or in the vicinity of the insulated outer walls. The part of the duct electrode 12 being connected to one terminal of the high voltage source could be made of current carrying, semi-conductive or antistatic material, preferably a cellulose-based material having different electrical properties or some kind of paint being electrically conductive. Said part can also be manufactured from a current carrying material, e.g. in the shape of a thread or a band coated with an insulating outer casing and preferably arranged in such a way that said thread or said band constitutes/defines the delimiting walls of the air flow duct, i.e. it is in no way necessary that the walls of the air flow duct constitute homogene surfaces. The last-mentioned fact could be of practical use when e.g. several elongated corona electrodes are used.

As mentioned earlier the duct electrode 12 should preferably be connected to such a potential that the voltage between the corona electrode 10 and the duct electrode 12 is at a level corresponding to the access of voltage. The benefit of the design of the dubt electrode 12 is among other things that it is fairly easy to get access to a very high voltage if, as is the case for the duct electrode 12, the connection to the high voltage source does not impose any current load upon the voltage source. In such a case the duct electrode 12 is preferably electrically connected to a voltage that is more negative relative to the ion potential than the target electrode 16. Corresponding thereto the duct electrode 14 is designed in a similar way but with the difference that the duct electrode 14 should be connected to a voltage closest to the voltage of the corona electrode or higher in order to achieve efficient screening of the migration of the ions in direction upwards, i.e. in direction towards the undesired air flow through the device.

The parts of the duct electrodes 12 and 14 being connected to the high voltage are due to their design unsuitable to simultaneously constitute the outer casing of the device. Therefore it is suitable to provide a further coating or surface of insulating material and then preferably to coat said coating/surface with an electrical current carrying material that is connected to earth.

In certain cases it is interesting due to touch to connect the target electrode to earth or close to earth potential. In such case it is a benefit if the duct electrode 12 is connected to a negative voltage and the corona electrode to a positive voltage.

By the presence of the duct electrodes 12 and 14 and their different embodiments a possibility has been created to design ion-wind devices of different embodiments. The expression duct electrode 12 and 14 respectively is therefore given a broader meaning than devices built up around physical ducts. Thanks to the new method to initiate in an air flow duct ion migration of even ion density the efficiency of the ion-wind has increased dramatically for a device according to the present invention compared to previously known devices. This ion-wind technique results among other things in a higher pressure generation. It has been shown in laboratory tests that a device according to the characterizing features of the patent claims preferably can be used to cool electronics, e.g. cooling of computer equipment, copying equipment and/or other electrical equipment where the abscence of noise is of great importance for the user or where the need for long and guaranteed operation time is demanded.

From this description it can be learned that it is not necessary to have physical duct walls both upstream of and downstream of the corona electrode 10. By the aid of the duct electrode 12 it is however necessary to provide sufficient field concentration around the corona electrode 10 to generate the ion clouds, to accelerate the generation of new ions through the target electrode 16 and to prevent migration of ions in undesired air flow direction through the device by suitable location and voltage connection of the duct electrode 14. It is not necessary that the air intake is upstream of the corona electrode. This can be effected on both sides of a possible air flow duct in the shape of a surface permeable to the air flow and the target electrode 16 being arranged downstream of said surface via the open air flow structure of the duct electrode 12.

Preferably the device can of course also be used for air purification and not only for air transportation.

Of course the precipitator of the device according to the invention can be designed in a way previously described in patent application PCT/SE85/00236 and other applications in the patent portfolio of TL Vent. However, the difference of the preferred embodiment of the present application is the possibility to design screen-protected and very efficient precipitation electrodes. The repelling electrode can of course be designed in several different ways.

The repelling electrode can be made out of both current carrying as well as semi-conductive and also antistatic material, said electrode is not necessarily arranged on the outer side of the air flow duct. The repelling electrode can alternatively be located with a target electrode and essentially in parallel with each other in an air flow duct, the repelling electrode being connected electrically to a terminal of the high voltage source and the target electrode to the other terminal of the high voltage source. In certain cases it is suitable to have the latter earthed. It is not necessary that the repelling electrode has the same voltage polarity as the target electrode. Said electrode can be located a certain distance further down in an air flow duct than the target electrode and have the same polarity as the corona electrode.

The present invention is so far described in connection with on one hand an extended corona electrode and on the other hand a pointed corona electrode. Of course it is also possible to use other previously known embodiments of corona electrodes and design the device in accordance with the appending claims.

There is no requirement that the target electrode 16, being electrically connected to one terminal of the high voltage source, has to be negative relative to earth potential and negative relative to the potential of the corona electrode. In certain practical embodiments the target electrode is electrically connected to earth or a potential close to earth. Simultaneously the corona electrode may be connected to positive or negative voltage relative to earth.

In most practical applications positive corona discharge is referred to avoid an excessive generation of ozone, i.e. connection to positive voltage. When connecting the target electrode to a voltage level close to earth it is also practical to electrically connect the duct electrode 12 to earth and hende said electrode can constitute the casing of the device.

I claim:

1. A device for transporting air with the aid of electrical ion-wind, said device comprisinq:

least one corona electrode (10), a duct electrode (12) located at a distance from the corona electrode (10), insulating material, and a d.c. voltage source (11) having a first terminal connected to the corona electrode (10) and a second terminal connected to the duct electrode (12), the design of the corona electrode (10) and the voltage between said terminals of the d.c. voltage source (11) being such that a corona discharge generating air ions occurs at the corona electrode (10), and wherein the duct electrode (12) includes a material having a certain conductivity, said duct electrode being connected to said second terminal of the d.c. voltage source (11), and wherein the insulating material (13) has electrically insulating properties and is so arranged and located relative both the corona electrode (10) and the duct electrode that essentially no current from the corona electrode reaches the duct electrode (12).

2. The device according to claim 1, further comprising: a target electrode (16) arranged at a distance from the corona electrode (10) and essentially downstream of said corona electrode (10) relative to the desired air flow direction, said target electrode (16) being connected to the second terminal of the high voltage source (11).

3. The device according to claim 2, further comprising a second duct electrode arranged upstream of the corona electrode (10) relative to the desired air flow direction through the device, said second duct electrode being made of a current carrying frame and an electrically insulating casing and being electrically connected to the first terminal of the high voltage source (11).

4. A device for transporting air using electrical ion-wind, said device comprising:

an air flow duct comprising walls composed of insulating material;

a d.c. voltage source having first and second terminals;

a corona electrode disposed in the air flow duct, said corona electrode being connected to the first terminal of the voltage source; and a duct electrode disposed exterior to the air flow duct and mounted on the walls, said duct electrode being connected to the second terminal of the voltage source and being covered with an inner laver of insulating material and an outer layer of conductive material connected to earth ground.

5. The device of claim 4, wherein the duct electrode is disposed downstream of the corona electrode.

6. The device of claim 5, further comprising a target electrode disposed in the air flow duct, downstream of the duct electrode, said target electrode being connected to the second terminal of the voltage source.

7. The device of claim 5, further comprising a second duct electrode disposed exterior to the air flow duct, upstream of the corona electrode, said second duct electrode being connected to the first terminal of the voltage source.

8. A device for transporting air using electrical ion-wind, said device comprising:

a d.c. voltage source having first and second terminals;

a corona electrode connected to the first terminal of the voltage source;

a duct electrode connected to the second terminal of the voltage source, said duct electrode being disposed downstream of the corona electrode;

a target electrode connected to the second terminal of the voltage source, said target electrode being disposed downstream of the duct electrode; and insulating material disposed between the duct electrode and the target electrode.

9. The device of claim 8, wherein the insulating material is a wall of an air flow duct; and wherein the corona electrode and the target electrode are disposed in the air flow duct, and the duct electrode is disposed exterior to the air flow duct.

10. The device of claim 9, further comprising a second duct electrode disposed exterior to the air flow duct, upstream of the corona electrode, said second duct electrode being connected to the first terminal of the voltage source.

* * * * *

UNITED STATES PATENT AND TRADEMARK OFFICE

CERTIFICATE OF CORRECTION

PATENT NO. : 5,982,102

DATED : November 9, 1999

INVENTOR(S) : Andrzej

It is certified that error appears in the above-indentified patent and that said Letters Patent is hereby corrected as shown below:

Column 1, Line 66, delete "unfavourable" and insert --unfavorable--.

Column 2, Line 61, delete "Whe" and insert --the--.

Column 2, Line 62, delete "sore" and insert --some--.

Column 5, Line 45, delete "certain," and insert --certain--.

Column 7, Line 11, delete "dubt" and insert --duct--.

Column 7, Line 30, delete "electrical" and insert --electric--.

Column 8, Line 44, delete "referred" and insert --preferred--.

Signed and Sealed this

Twenty-fifth Day of July, 2000

*Attest:*

*Attesting Officer*

Q. TODD DICKINSON

*Director of Patents and Trademarks*

UNITED STATES PATENT AND TRADEMARK OFFICE

CERTIFICATE OF CORRECTION

PATENT NO. : 5,982,102

DATED : November 9, 1999

INVENTOR(S) : Andrzej

It is certified that error appears in the above-indentified patent and that said Letters Patent is hereby corrected as shown below:

Column 8, Line 48, delete "hende" and insert --hence--.

Column 8, Line 51, (Claim 1), delete "comprisinq" and insert --comprising--.

Column 8, Line 52, (Claim 1), before "least" insert --at--.

Signed and Sealed this

Twenty-fifth Day of July, 2000

*Attest:*

*Attesting Officer*

Q. TODD DICKINSON

*Director of Patents and Trademarks*